US005684334A

United States Patent [19]

Zenmei et al.

[11] Patent Number: 5,684,334

[45] Date of Patent: Nov. 4, 1997

[54] STARTER DEVICE HAVING PINION MOVEMENT STOPPER MECHANISM FORMED AT THE HELICAL SPLINES OF THE OUTPUT SHAFT AND HAVING REDUCED DIAMETER THRUST WASHER

[75] Inventors: Keisaku Zenmei; Shuzo Isozumi, both of Himeji, Japan

[73] Assignee: Mitsubishi Denki Kabushiki Kaisha, Tokyo, Japan

[21] Appl. No.: 384,750

[22] Filed: Feb. 7, 1995

[30] Foreign Application Priority Data

Sep. 29, 1994 [JP] Japan ..... 6-262112

[51] Int. Cl.[6] ..... F02N 11/00; F02N 11/02

[52] U.S. Cl. ..... 290/38 R; 290/48; 74/7 R

[58] Field of Search ..... 290/38 R, 38 A, 290/38 B, 48; 74/6, 7 R, 7 A–7 E, 8, 9

[56] References Cited

U.S. PATENT DOCUMENTS

| | | | |
|---|---|---|---|
| 1,144,097 | 6/1915 | Bendix | 74/7 D |
| 2,818,735 | 1/1958 | Sabatini | 74/7 R |
| 4,455,490 | 6/1984 | Giardini et al. | 290/38 A |
| 4,902,905 | 2/1990 | Morishita | 290/48 |
| 4,929,857 | 5/1990 | Isozumi | 310/83 |
| 5,035,151 | 7/1991 | Isozumi | 74/7 A |
| 5,169,245 | 12/1992 | Harada et al. | 384/610 |
| 5,199,309 | 4/1993 | Isozumi | 74/7 E |
| 5,379,622 | 1/1995 | Saito et al. | 72/88 |

FOREIGN PATENT DOCUMENTS

| | | |
|---|---|---|
| 2661958 | 11/1991 | France . |
| 55-53727 | 12/1980 | Japan . |
| 1-190967 | 1/1989 | Japan . |
| 2163469 | 6/1990 | Japan . |

*Primary Examiner*—Steven L. Stephan
*Assistant Examiner*—Christopher Cuneo
*Attorney, Agent, or Firm*—Sughrue, Mion, Zinn, Macpeak & Seas

[57] ABSTRACT

A starter device having a reduced output shaft diameter is provided. A stopper mechanism for impeding the outward movement of the pinion (12) along the output shaft (3*a*) is implemented by forming the helical splines (31) on the output shaft (3*a*) as being alternately open (31*a*, 31*b*) and closed (32*a*) helical splines. The thrust washer (21), for bearing the outward axial force of the output shaft (3*a*), is disposed in the front bracket (5) of the starter in front of the front bearing (16) and opposed to the front end (3*d*) of the output shaft (3*a*). Both the stopper mechanism and thrust washer configuration according to the invention allow for a reduced diameter of the output shaft (3*a*). The reduced diameter of the output shaft, in turn, affords the option of making the pinion (12) smaller in diameter.

6 Claims, 3 Drawing Sheets

STARTER DEVICE HAVING PINION MOVEMENT STOPPER MECHANISM FORMED AT THE HELICAL SPLINES OF THE OUTPUT SHAFT AND HAVING REDUCED DIAMETER THRUST WASHER

BACKGROUND OF THE INVENTION

FIELD OF THE INVENTION

The present invention relates to a stopper of a front nose type starter device and to a manner of receiving a thrust load of an output shaft thereof.

DISCUSSION OF BACKGROUND

FIG. 4 is a sectional view showing a conventional starter device which is disclosed in Japanese Unexamined Patent Publication No. 190967/1989 for instance, and FIG. 5 shows a magnified sectional view of a portion thereof surrounding a stopper.

In FIGS. 4 and 5, numeral 1 designates a starter device, numeral 2 designates an armature, numeral 3 designates an armature rotating shaft, notation 3*a* designates an output shaft, numeral 4 designates an overrunning clutch, numeral 5 designates a front bracket, numeral 6 designates a switch coil, numeral 7 designates a movable core, numeral 8 designates a movable terminal, numeral 9 designates a fixed terminal, numeral 10 designates a return spring, numeral 11 designates a shift lever, numeral 12 designates a pinion for driving an engine which moves in the axial direction through helical splines formed on the output shaft 3*a*, numeral 13 designates a ring gear, numeral 14 designates a stopper, numeral 15 designates a ring for fixing a stopper which is provided in a groove 3*b* that is installed on the output shaft 3*a* at the front end of the rotating shaft 3, numeral 16 designates a front bearing, numeral 17 designates a cap, and numeral 18 designates a washer.

Next, an explanation will be given of the operation. When current is made flow to in the switch coil 6, the movable core 7 is drawn into the coil 6, the overrunning clutch 4 and the pinion 12 are pushed in the forward direction through the shift lever 11, and the pinion 12 is brought in mesh with the ring gear 13. At the same time, the movable terminal 8 and the fixed terminal 9 are closed, a large current flows in the motor unit, whereby a torque is generated and the engine is started. At this instance, the movement of the overrunning clutch 4 is restricted by rendering the pinion 12 to contact the stopper 14.

Next, when the flow of current of the switch is discontinued, the movable core 7 returns to its original position by the operation of the return spring 10, and the clutch returns to the original position through the shift lever 11, thereby finishing the operation.

In the meantime, in this conventional device, the stopper 14 for restricting the movement of the overrunning clutch 4, the ring 15 for fixing the stopper 14 and the ring groove 3*b* for fitting the ring are arranged on the rear side of the front bearing 16. Therefore, an impact force in engaging the pinion 12 with the ring gear 13 concentrates on the ring groove 3*b*, whereby the diameter of the output shaft is restricted in view of its strength, and the number of teeth of the pinion has been determined to be 8 with the module (pitch divided by pi) of 2.54 diametral pitch of (DP10) and 9 with the module of 2.117 diametral pitch of (DP12) as its minimum level. It is noted that the relationship between module and diametral pitch is according the following expression:

$$DP = \frac{25.4}{m}$$

where DP corresponds to diametral pitch and m corresponds to module.

Further, in this construction, a step portion 3*c* of the output shaft abuts against the washer 18 which has been press-fitted on the rear side of the front bearing 16, and the cap 17 has been calked to the front end of the front bracket 5 for dust proofing.

In general, the size of the motor unit is inversely proportional to the gear ratio of the ring gear versus the pinion of an engine. Therefore, in the case of reducing the number of teeth of the pinion with the purpose of downsizing the motor unit, or, for instance, in the case of 7 teeth of the pinion with the module of 2.54 and 8 teeth thereof with the module of 2.117, in the conventional structure, it is not possible to further reduce the shaft diameter in consideration of the strength of the ring groove. Accordingly, the radial thickness under the dedendum circle of the pinion is reduced, and the strength on the side of the pinion can not be ensured. Therefore, in the conventional structure, it is not possible to reduce the number of teeth of the pinion.

Further, even if the shaft diameter is reduced, it is not possible to further reduce the diameter thereof at the front bearing portion in view of the strength considerations. When the difference between the shaft diameter of the pinion and the shaft diameter at the front bearing is reduced, or the step-like difference between those diameters is dispensed with, it is difficult for the washer on the rear side of the front bearing to receive the thrust load.

Furthermore, a problem arises in press-fitting the thrust washer 18, which is press-fitted into the front bracket 5 after the bearing 16 has been press-fitted, therein. Since the outer diameter of the washer 18 is made comparatively large, the wall thickness $t_2$ of the front bracket 5 at the press-fitting portion is reduced. Additionally, in press-fitting the washer 18 into the front bracket 5 which is already under the stress of the press-fitting pressure of the bearing 16, there is a danger of causing cracks in the front bracket 5.

SUMMARY OF THE INVENTION

It is an object of the present invention to resolve these problems, and to provide a highly reliable starter device wherein the number of teeth of a pinion is reduced by decreasing the diameter of the output shaft, whereby, for instance, it is possible to render the number of teeth of the pinion to 7 with the module of 2.54 and 8 with the module of 2.117, the motor unit is downsized by enhancing the gear ratio of the ring gear versus the pinion of an engine, and on the other hand, the thrust load can sufficiently be received even with the smaller diameter of the output shaft.

According to an aspect of the present invention, there is provided a starter device of a front nose type in which a pinion for driving an engine moves over an output shaft of a starter in an axial direction through helical splines formed on the output shaft a front end of which is supported by a front bearing disposed in front of the pinion and fitted to an inner periphery of a front bracket, wherein a stopper mechanism having a pinion movement stopper is formed at the helical splines of the output shaft and a thrust load in moving the pinion in an outward direction is received by a front end face of the output shaft.

According to the starter device of this invention, it is possible to reduce the diameter of the output shaft by providing a stopper mechanism having the pinion movement stopper at the helical splines, and it is sufficiently possible to receive the thrust load even if the shaft diameter is reduced, since the washer is installed in front of the front bearing which receives the thrust load of the output shaft.

DETAILED DESCRIPTION OF THE PREFERRED EMBODIMENTS

EXAMPLE 1

An explanation will be given of an example of this invention in reference to the drawings as follows.

Figure 1:
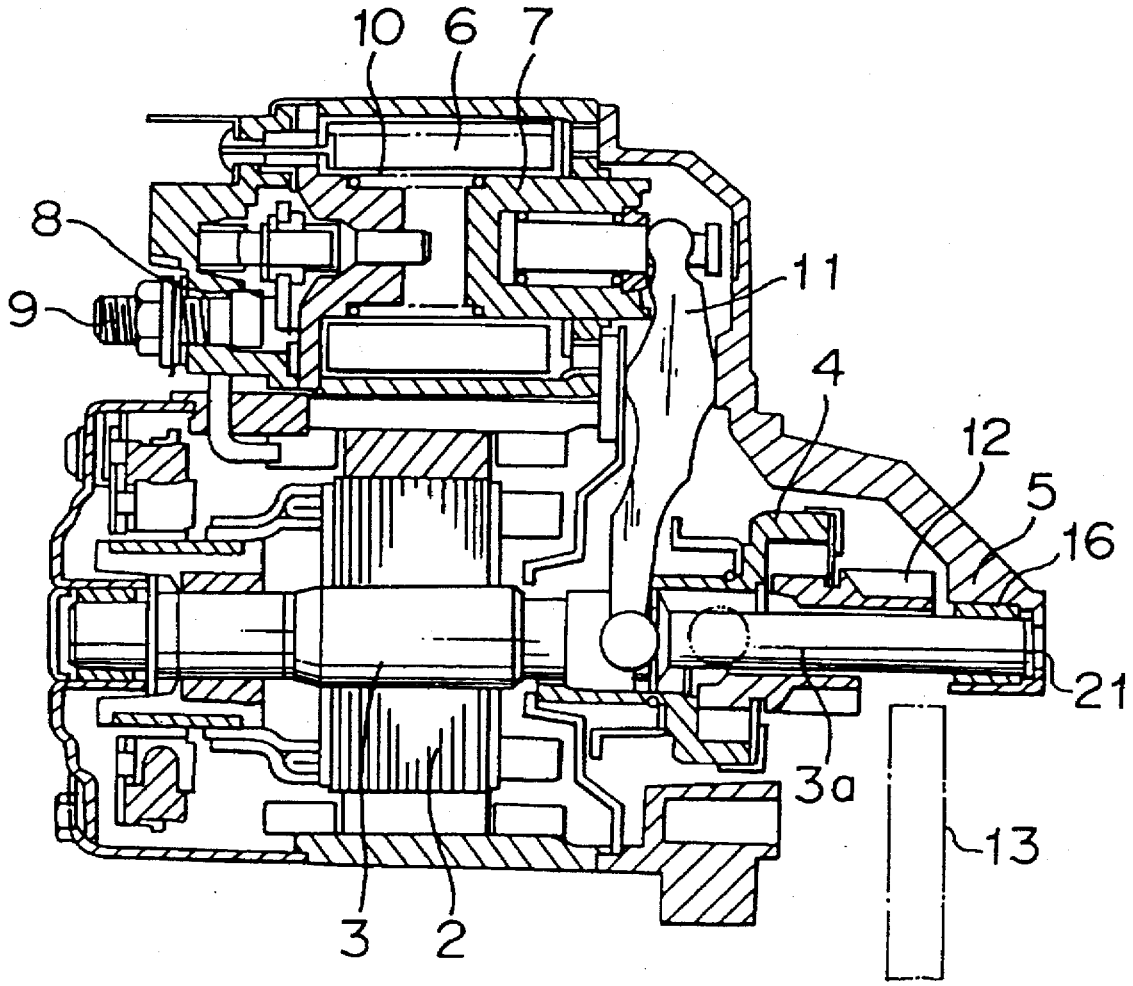
FIG. 1 is a sectional view showing an example of the present invention.
Figure 2:
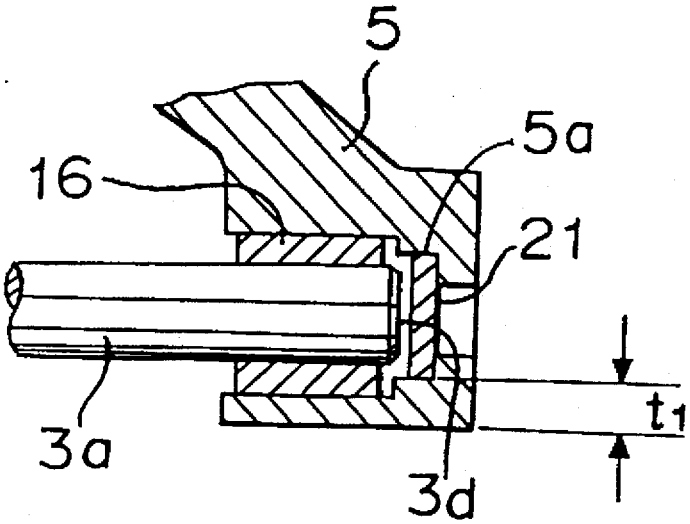
FIG. 2 is a magnified sectional view showing a front end portion of an output shaft of FIG. 1.
Figure 3:
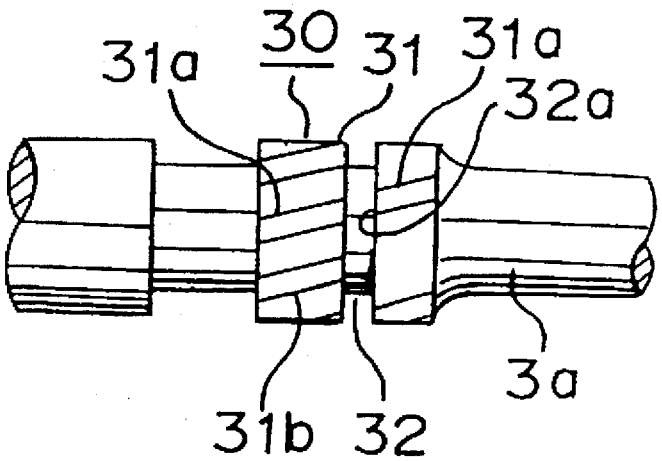
FIG. 3 is a magnified sectional view showing a portion surrounding a stopper of FIG. 1.
Figure 4:
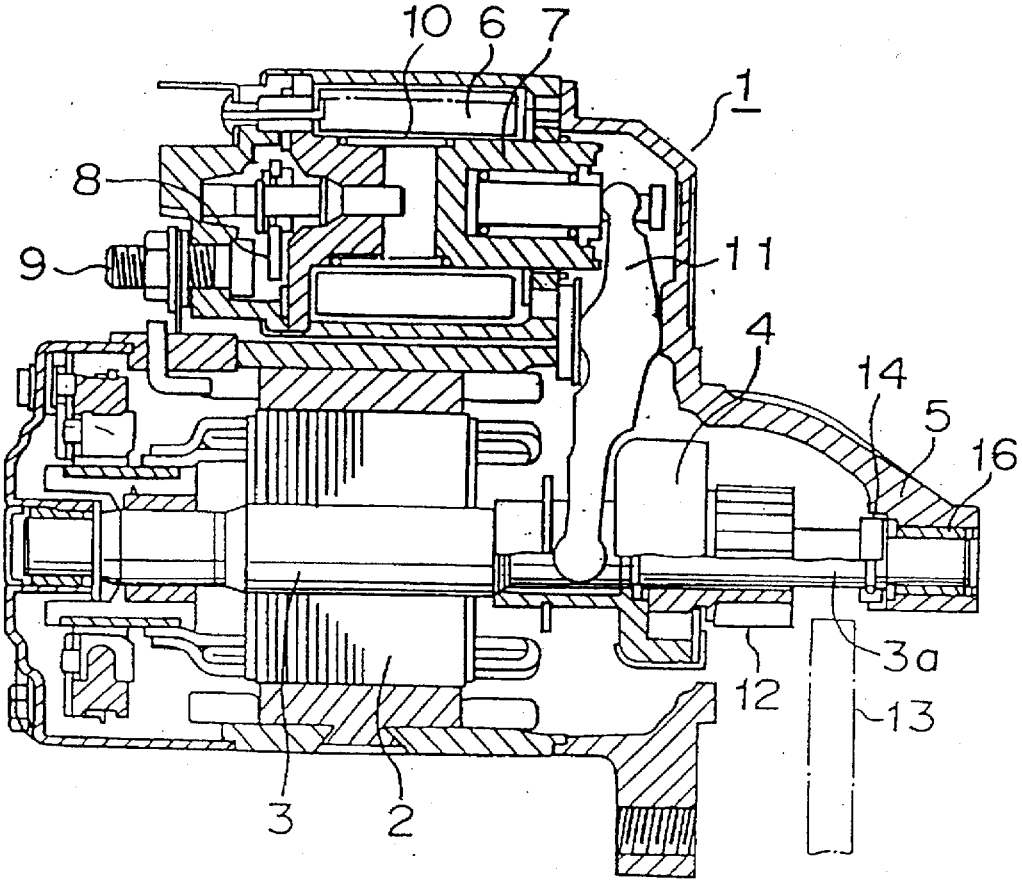
FIGURE 4 PRIOR ART
FIG. 4 is a sectional view showing an example of a conventional starter device.

FIG. 1 is a sectional view of a starter device according to the present invention, wherein the upper half portion of the pinion in the drawing has been moved in the forward direction. FIGS. 2 and 3 show magnified sectional views of portions thereof surrounding a front end portion of the output shaft and a stopper. In FIGS. 1, 2 and 3, numeral 4 designates the overrunning clutch, numeral 5 designates the front bracket, numeral 12 designates the pinion, and numeral 16 designates the front bearing, which are the same as in the conventional device including the motor unit and the electromagnetic switch unit. Next, numeral 21 designates a disk-like washer which has been press-fitted to an inner peripheral groove 5*a* of the front bracket 5 in front of the front bearing 16, which is disposed opposing an end face 3*d* of the output shaft 3*a*, and which receives the thrust load by abutting against the end face 3*d* when the pinion is moved in the outward direction.

Further, numeral 30 in FIG. 3 designates a well-known (described in Japanese Examined Utility Model 53727/1980) stopper mechanism which is formed at helical splines 31 on a step portion of the output shaft 3*a*. In FIG. 3, notation 31*a* designates first splines penetrating in the axial direction through an interposed groove 32, and notation 31*b* designates second splines which has been cut on the rear side of the groove 32, wherein a wall face 32*a* of the groove 32 is a stopper.

Accordingly, this stopper mechanism is integrated with a pinion by mating the helical splines of the pinion with the helical splines of the output shaft which are formed having a group of closed splines arranged at every other helical groove and another group of open helical splines arranged at every other helical groove with the closed portions being at the front side.

By adopting the stopper structure of FIG. 3 as above, it is not necessary to provide a stopper groove on the output shaft, which is advantageous in view of its superior strength without the groove. Therefore, it is possible to reduce the diameter of the output shaft, and to render the number of teeth of the pinion to 7 with the module M=2.54 and 8 with the module M=2.117. On the other hand, since the shaft diameter at the front bearing can not be reduced in view of the strength considerations, the step difference of diameters of the output shaft is dispensed with in order to decrease the assembly steps, and the thrust load is received by the front end face of the output shaft. The thrust load can sufficiently be received even if the shaft diameter is small, since the thrust load is received by the front end face of the output shaft in such a manner.

Figure 5:
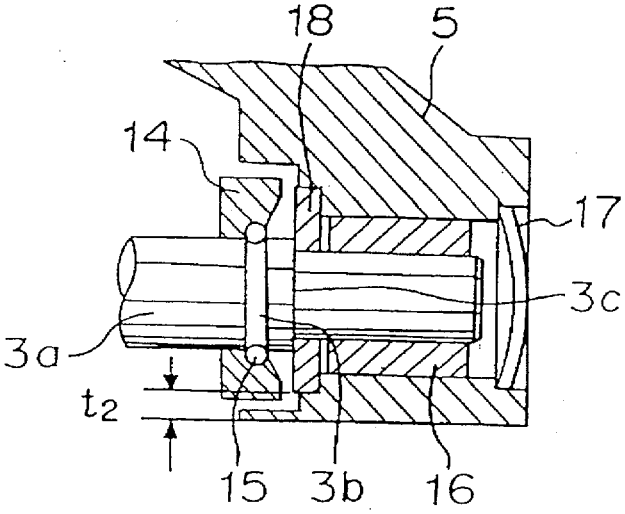
FIGURE 5 PRIOR ART
FIG. 5 is a magnified sectional view showing a front end portion of an output shaft of FIG. 4.

Further, in the case of the location of the conventional washer 18 in FIG. 5, the increased diameter of the washer makes it difficult to sufficiently provide the wall thickness of the housing of the front bracket 5. Also, the washer is press-fitted to the front bracket 5 after the front bearing 16 has already been press-fitted thereto. Therefore, the washer 18 is further press-fitted under a state wherein the press-fitting pressure of the bearing 16 is being applied on the housing 5, and therefore, there is a danger of cracking the housing.

In this regard, in the invented structure, as shown in FIG. 2, the wall thickness $t_1$ of the housing of the front bracket wherein the washer is press-fitted is larger than the above wall thickness $t_2$. Therefore, the above problems are resolved and the manufacturing of the starter is simplified since it is not necessary to make the washer in a doughnut shape, and the conventional front end cap 17 can be abolished since the washer is also used as a lid.

As stated above, the stopper mechanism adopted according to the present invention is provided by way of a pinion movement stopper at a portion of the helical splines on the output shaft, thereby achieving the downsizing of the diameter of the output shaft. The thrust washer is arranged in front of and opposing the front side of the front bearing to provide a function of sufficiently receiving the thrust load to compensate for the downsizing. Therefore, the invention achieves the following various effects.

(a) The number of teeth of the pinion is reduced, the speed reduction ratio of the engine versus the starter can be increased and therefore, the downsizing of the starter can be achieved, since the diameter of the output shaft can be reduced.

(b) The structure can sufficiently receive the thrust load and it is not necessary to render the washer in a doughnut shape by which a press-mold thereof is easy to make, since the thrust is received at the front end face of the shaft.

(c) The front end step portion of the output shaft can be dispensed with, which facilitates the manufacturing operation.

(d) The conventional front end cap can be abolished since the thrust washer is arranged on the front side of the front bearing.

(e) There is no danger of cracking in press-fitting the washer and further, the interference of the washer is easy to control, since a sufficient wall thickness of the housing of the front bracket can be provided.

What is claimed is:

1. A starter device of a front nose type comprising:

a pinion for driving an engine;

an output shaft having a front end with a front end face at the extreme front end thereof, and having helical splines formed thereon, said pinion moving over said output shaft in an axial direction through said helical splines;

a front bearing which is disposed in front of said pinion and is fitted to an inner periphery of a front bracket of the starter device, said front bearing supporting said front end of said output shaft;

a stopper mechanism having a pinion movement stopper formed at the helical splines of the output shaft; and a thrust washer, disposed in front of said front end face of said output shaft, for receiving a thrust load in moving the pinion in an outward direction by abutting said front end face of the output shaft, said thrust washer being press fit into said front bracket of said starter device.

2. The starter device according to claim 1, wherein a module of the pinion is 2.54 and a number of teeth thereof is 7.

3. The starter device according to claim 1, wherein a module of the pinion is 2.117 and a number of teeth thereof is 8.

4. A starter device of a front nose type comprising:

a pinion for driving an engine;

an output shaft having a front end with a front end face at the extreme front end thereof and having helical splines formed thereon, said pinion moving over said output shaft in an axial direction through said helical splines;

a front bearing which is disposed in front of said pinion and is fitted to an inner periphery of a front bracket of the starter device, said front bearing supporting said front end of said output shaft;

a stopper mechanism having a pinion movement stopper, located at the helical splines of the output shaft, which is formed as alternating open and closed helical splines; and a thrust washer, disposed in front of said front end face of said output shaft, for receiving a thrust load in moving the pinion in an outward direction by abutting said front end face of the output shaft, said thrust washer being press fit into said front bracket of said starter device.

5. The starter device according to claim 4, wherein a module of the pinion is 2.54 and a number of teeth thereof is 7.

6. The starter device according to claim 4, wherein a module of the pinion is 2.117 and a number of teeth thereof is 8.

* * * * *